US008413456B2

(12) United States Patent
Tomioka et al.

(10) Patent No.: US 8,413,456 B2
(45) Date of Patent: Apr. 9, 2013

(54) REFRIGERATION APPARATUS

(75) Inventors: Satoshi Tomioka, Kawasaki (JP); Hideya Tamura, Kawasaki (JP); Tetsuya Ito, Kawasaki (JP); Takahiro Matsunaga, Kawasaki (JP); Takamitsu Kurokawa, Kawasaki (JP); Shintaro Sanada, Kawasaki (JP)

(73) Assignee: Fujitsu General Limited, Kawasaki-Shi (JP)

( * ) Notice: Subject to any disclaimer, the term of this patent is extended or adjusted under 35 U.S.C. 154(b) by 726 days.

(21) Appl. No.: 12/591,853

(22) Filed: Dec. 3, 2009

(65) Prior Publication Data

US 2010/0146998 A1 Jun. 17, 2010

(30) Foreign Application Priority Data

Dec. 11, 2008 (JP) ..... 2008-315656

(51) Int. Cl.
*F25B 41/00* (2006.01)
*F25D 23/12* (2006.01)

(52) U.S. Cl.
USPC ..... 62/196.4; 62/196.1; 62/259.1

(58) Field of Classification Search ..... 62/196.1, 62/196.4, 228.3, 259.1, 430, 149
See application file for complete search history.

(56) References Cited

U.S. PATENT DOCUMENTS 7,954,333 B2 * 6/2011 Yoshimi ..... 62/129

FOREIGN PATENT DOCUMENTS

| | | | |
|---|---|---|---|
| JP | 2000-220894 A | | 8/2000 |
| JP | 2008-164265 A | | 7/2008 |
| JP | 2008249228 A | * | 10/2008 |
| WO | WO 2007126055 A1 | * | 11/2007 |

OTHER PUBLICATIONS

Japan Patent Office, "Office Action for JP 2008-315656", Sep. 26, 2012.

* cited by examiner

*Primary Examiner* — Chen Wen Jiang
(74) *Attorney, Agent, or Firm* — Manabu Kanesaka

(57) ABSTRACT

There is provided a refrigeration apparatus in which a refrigerant accumulating in non-operating outdoor units is supplied to an outdoor unit being operated in which a shortage of refrigerant occurs without starting the compressors of the non-operating outdoor units. In the control method for the refrigeration apparatus in which to refrigerant piping 10 installed between the indoor side and the outdoor side, a plurality of outdoor units 30A, 30B each including a compressor 31, a directional control valve 34, an outdoor heat exchanger 35, an outdoor expansion valve 36, and an accumulator 37 are connected in parallel on the outdoor side, and each of the outdoor units is provided with a hot gas bypass circuit 38 that includes a solenoid valve 38*a* and an expansion mechanism 38*b* arranged in series, and is connected between high-pressure side piping 33*a* on the discharge side of the compressor and low-pressure side piping 33*b* on the accumulator side, if a shortage of refrigerant occurs when air cooling operation is performed in a state in which only the outdoor unit 30A is operated and other outdoor units 30B are not operated, the solenoid valves 38*a* of the non-operating outdoor units 30B are opened so that the refrigerant accumulating in the non-operating outdoor units 30B is supplied to the outdoor unit 30A via the hot gas bypass circuit 38 and the low-pressure piping 33*b*.

1 Claim, 2 Drawing Sheets

REFRIGERATION APPARATUS

CROSS-REFERENCE TO RELATED APPLICATIONS

The present application is based on, and claims priority from, Japanese Application Serial Number JP2008-315656, filed Dec. 11, 2008, the disclosure of which is hereby incorporated by reference herein in its entirety.

TECHNICAL FIELD

The present invention relates to a control method for a refrigeration apparatus suitable for large buildings such as office buildings and apartment houses, in which apparatus a plurality of indoor units are provided on the indoor side and a plurality of outdoor units are provided on the outdoor side, and the indoor units and the outdoor units are connected to each other via refrigerant piping. More particularly, it relates to a technique for solving a shortage of refrigerant at the time when air cooling operation is performed in a state in which only a predetermined outdoor unit of the plurality of outdoor units is operated and other outdoor units are not operated.

BACKGROUND ART

In air-conditioning equipment for a large building such as an office building and an apartment house, the required air cooling capacity or heating capacity differs depending on the number of operating indoor units. Therefore, to meet this condition, a plurality of outdoor units are sometimes used.

In this case, each of the outdoor units is provided with a compressor, a four-way valve (directional control valve), an outdoor heat exchanger, an outdoor expansion valve, and an accumulator, and the outdoor units are connected in parallel to refrigerant piping via branch pipes.

As the compressor, a variable-speed compressor (inverter compressor) in which the rotational speed thereof is variable due to inverter control or a constant-speed compressor in which the rotational speed is constant is usually used. Preferably, to keep the pressure difference between the discharge side and the suction side in a predetermined range, the compressor is provided with a hot gas bypass circuit, which includes a solenoid valve and an expansion mechanism arranged in series, between a discharge pipe and a suction pipe.

The outdoor unit is operated according to the capacity required on the indoor side, and therefore in some cases, for example, only one outdoor unit is operated, and other outdoor units are not operated (hereinafter, an outdoor unit not being operated is sometimes referred to as a "non-operating outdoor unit").

In such a case, a refrigerant accumulates in the non-operating outdoor units, so that in the outdoor unit being operated, a shortage of refrigerant may occur. If the refrigerant runs short, the liquid-side piping becomes in a two-phase state of gas and liquid, and problems of the decreased capacity of indoor unit, production of refrigerant noise, and the like occur.

To solve these problems, in the invention described in Patent Document 1 (Japanese Patent Application Publication No. 2000-220894), when a shortage of refrigerant occurs in the outdoor unit being operated, the non-operating outdoor units are operated so as to supply the refrigerant accumulating in the non-operating outdoor units to the refrigerant piping.

According to the invention described in Patent Document 1, the refrigerant can be supplied quickly to the outdoor unit being operated, in which the refrigerant runs short. However, this invention is unpreferable in terms of energy saving because electric power necessary for starting the compressors of the non-operating outdoor units is consumed.

SUMMARY OF THE INVENTION

Accordingly, an object of the present invention is to provide a refrigeration apparatus provided with a plurality of outdoor units, in which a refrigerant accumulating in non-operating outdoor units is supplied to an outdoor unit being operated in which a shortage of refrigerant occurs without starting the compressors of the non-operating outdoor units.

To achieve the above object, the present invention provides a refrigeration apparatus in which to refrigerant piping including liquid-side piping and gas-side piping installed between the indoor side and the outdoor side, a plurality of indoor units each including an indoor expansion valve and an indoor heat exchanger are connected in parallel on the indoor side and a plurality of outdoor units each including a compressor, a directional control valve, an outdoor heat exchanger, an outdoor expansion valve, and an accumulator are connected in parallel on the outdoor side; and each of the outdoor units is provided with a hot gas bypass circuit which includes a solenoid valve and an expansion mechanism arranged in series, and is connected between high-pressure piping on the discharge side of the compressor and low-pressure piping on the accumulator side, wherein if a shortage of refrigerant occurs in the refrigerant piping when air cooling operation is performed in a state in which at least only one outdoor unit of the plurality of outdoor units is operated and other outdoor units are not operated, the solenoid valves of the outdoor units not being operated are opened so that the refrigerant accumulating in the outdoor heat exchangers of the outdoor units not being operated is supplied to the gas-side piping of the refrigerant piping via the hot gas bypass circuit and the low-pressure piping.

According to the present invention, if a shortage of refrigerant occurs in the refrigerant piping when air cooling operation is performed in a state in which at least only one outdoor unit of the plurality of outdoor units is operated and other outdoor units are not operated, the solenoid valves of the outdoor units not being operated are opened so that the refrigerant accumulating in the outdoor heat exchangers of the outdoor units not being operated is supplied to the gas-side piping of the refrigerant piping via the hot gas bypass circuit and the low-pressure piping. Therefore, the refrigerant accumulating in the non-operating outdoor units can be supplied quickly to the outdoor unit being operated, in which the refrigerant runs short, without starting the compressor of the non-operating outdoor unit.

As a preferable mode, a subcooling heat exchanger is connected to the outlet side of the outdoor heat exchanger, and when a state in which the temperature difference between the high-pressure saturation temperature of the outdoor heat exchanger at the time of air cooling operation and the refrigerant temperature on the outflow side of the subcooling heat exchanger takes a predetermined value or a smaller value continues for a predetermined period of time, it is judged that the refrigerant runs short.

By judging whether the refrigerant runs short or not on the basis of the temperature difference between the high-pressure saturation temperature of the outdoor heat exchanger at the time of air cooling operation and the refrigerant temperature on the outflow side of the subcooling heat exchanger, the accuracy of judgment can be enhanced.

Also, as a preferable mode, the connecting part of the low-pressure piping to which the hot gas bypass circuit is connected is tilted so that the refrigerant supplied via the hot gas bypass circuit does not flow to the accumulator side on account of gravity.

According to this mode, the refrigerant accumulating in the non-operating outdoor units can surely supplied to the outdoor unit being operated.

DETAILED DESCRIPTION

An embodiment of the present invention will now be described with reference to FIGS. 1 and 2. The present invention is not limited to this embodiment.

Figure 1:
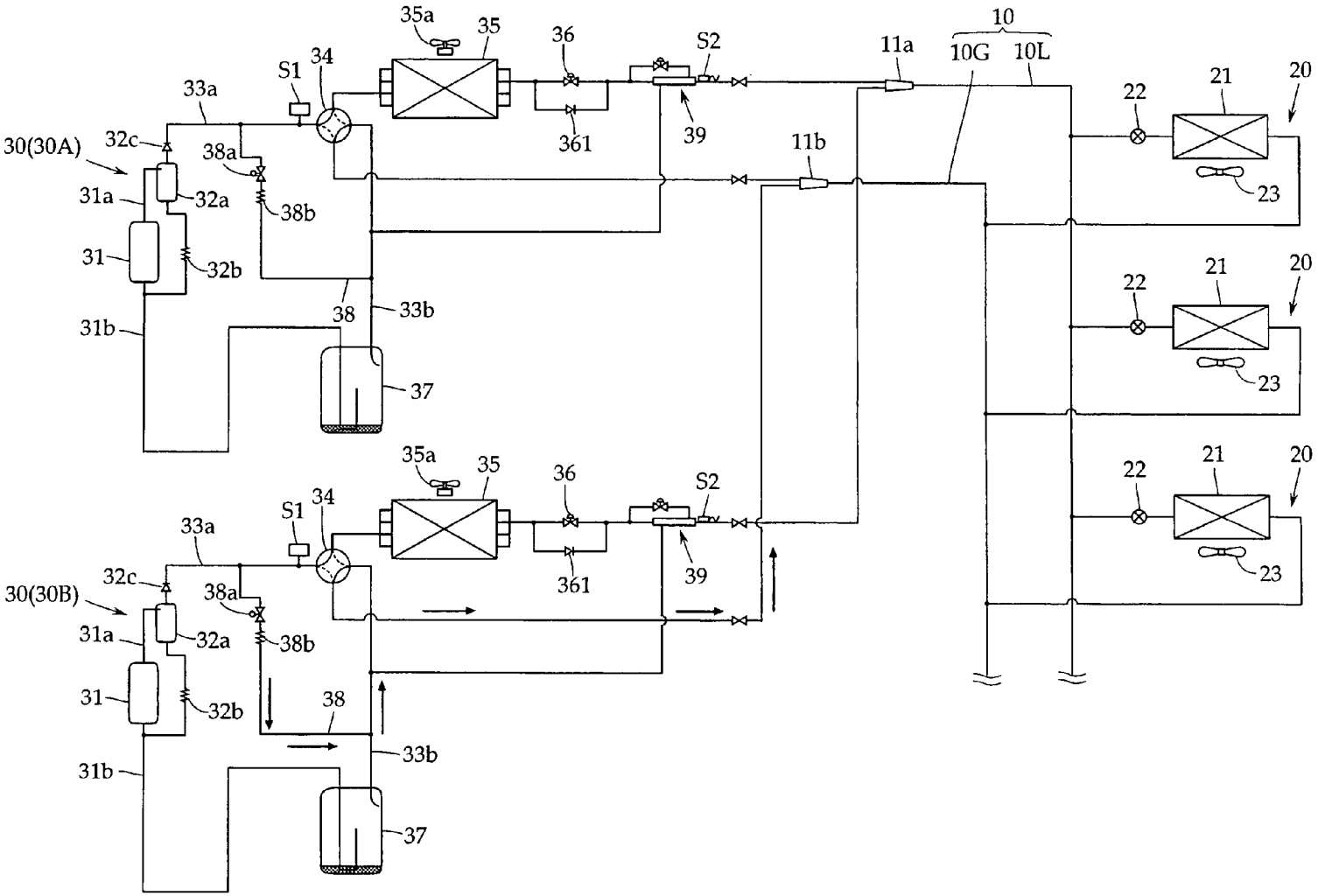
FIG. 1 is a refrigerant circuit diagram showing a general configuration of a refrigeration apparatus in accordance with an embodiment of the present invention.

Referring to FIG. 1, a refrigeration apparatus in accordance with the present invention is provided with refrigerant piping 10 including liquid-side piping 10L and gas-side piping 10G, which are installed between the indoor side and the outdoor side. To the refrigerant piping 10, a plurality of indoor units 20 are connected in parallel on the indoor side and a plurality of outdoor units 30 are connected in parallel on the outdoor side.

For convenience of drawing figures, FIG. 1 shows three indoor units 20. Each of the indoor units 20 includes an indoor heat exchanger 21, an indoor expansion valve 22, and a fan 23, and is installed at a place at which air conditioning of a building, not shown, is needed. One end side of the indoor heat exchanger 21 is connected to the liquid-side piping 10L via the indoor expansion valve 22, and the other end side thereof is connected to the gas-side piping 10G.

In this embodiment, regarding the outdoor units 30, two outdoor units of a first outdoor unit 30A and a second outdoor unit 30B are provided. Since these outdoor units 30A and 30B have the same configuration, when the outdoor units 30A and 30B need not be distinguished from each other, the outdoor units 30A and 30B are generally called the outdoor units 30.

The outdoor unit 30 includes, as a basic configuration, a compressor 31, a four-way valve (directional control valve) 34, an outdoor heat exchanger 35 having a fan 35*a*, an outdoor expansion valve 36, and an accumulator 37. Also, the outdoor unit 30 includes a subcooling heat exchanger 39 in addition to the outdoor heat exchanger 35.

As the compressor 31, any of an inverter compressor in which the rotational speed is variable (the capacity is variable), a constant-speed compressor in which the rotational speed is constant (the capacity is fixed), a rotary compressor, and a scroll compressor can be used.

The compressor 31 has a refrigerant discharge pipe 31*a* and a refrigerant suction pipe 31*b*. The refrigerant discharge pipe 31*a* is connected to the four-way valve 34 via an oil separator 32*a*, a check valve 32*c*, and high-pressure side piping 33*a*. The refrigerant suction pipe 31*b* is connected to the accumulator 37.

The liquid-side piping 10L is connected to the outdoor heat exchangers 35 of the outdoor units 30A and 30B via a branch pipe 11*a*. The gas-side piping 10G is connected to the four-way valves 34 of the outdoor units 30A and 30B via a branch pipe 11*b*. The piping leading from the four-way valve 34 to the accumulator 37 is low-pressure side piping 33*b*.

The oil separator 32*a* separates a refrigerator oil contained in the discharged gas, and the separated refrigerator oil is returned to the refrigerant suction pipe 31*b* via a capillary tube 32*b*.

Between the high-pressure side piping 33*a* and the low-pressure side piping 33*b*, a hot gas bypass circuit 38 including a solenoid valve 38*a* and a capillary tube (expansion mechanism) 38*b* arranged in series is connected to keep the pressure difference between the discharge side and the suction side of the compressor 31 in a predetermined range.

At the time of air cooling operation, the four-way valve 34 is switched over to a state indicated by solid lines in FIG. 1. Thereby, the gas refrigerant discharged from the compressor 31 is brought from the four-way valve 34 to the outdoor heat exchanger 35, being heat exchanged with the outside air, and is condensed (at the time of air cooling operation, the outdoor heat exchanger 35 acts as a condenser).

The liquid refrigerant condensed by the outdoor heat exchanger 35 passes through a check valve 361 connected in parallel to the outdoor expansion valve 36 and the subcooling heat exchanger 39, and is supplied to the indoor unit 20 via the liquid-side piping 10L.

On the indoor unit 20 side, the liquid refrigerant is decompressed to a predetermined pressure by the indoor expansion valve 22, and thereafter is heat exchanged with the indoor air by the indoor heat exchanger 21 to evaporate. Thereby, the indoor air is cooled (at the time of air cooling operation, the indoor heat exchanger 21 acts as an evaporator).

The gas refrigerant evaporated by the indoor heat exchanger 21 goes into the accumulator 37 via the gas-side piping 10G, the four-way valve 34, and the low-pressure side piping 33*b*. After the liquid refrigerant has been separated, the gas refrigerant is returned to the compressor 31 through the refrigerant suction pipe 31*b*.

At the time of heating operation, the four-way valve 34 is switched over to a state indicated by chain lines in FIG. 1. In this state, the indoor heat exchanger 21 acts as a condenser, and the outdoor heat exchanger 35 acts as an evaporator.

The outdoor units 30A and 30B are operated according to the capacity required on the indoor side. An explanation is given below of the control, for example, in the case where the second outdoor unit 30B is in a non-operating state, air cooling operation is performed by the first outdoor unit 30A only, and a shortage of refrigerant occurs.

The judgment of a state in which the refrigerant runs short can be made by the duration time of a state in which the temperature difference (Ti−To) between the high-pressure saturation temperature Ti of the outdoor heat exchanger 35 and the outflow-side refrigerant temperature To of the subcooling heat exchanger 39 takes a predetermined value (4° C. as one example) or a smaller value. That is to say, when a state of Ti−To 4° C. continues, for example, for two minutes, it can be judged that the refrigerant runs short.

The high-pressure saturation temperature Ti can be determined by the conversion from a discharged gas pressure detected by a pressure sensor S1 provided in the high-pressure side piping 33*a*, and the outflow-side refrigerant temperature To can be obtained by a temperature sensor S2 provided in the liquid-side piping 10L.

The judgment of a state in which the refrigerant runs short is made by a control section, not shown. When it is judged that the refrigerant runs short in the first outdoor unit 30A, the control section sends a request for discharging refrigerant to the non-operating outdoor unit 30B.

On receipt of this request for discharging refrigerant, the non-operating outdoor unit 30B opens the solenoid valve 38*a* of the hot gas bypass circuit 38 of its own unit.

Thereby, the refrigerant accumulating in the outdoor heat exchanger 35 of the non-operating outdoor unit 30B is supplied to the gas-side piping 10G of the first outdoor unit 30A via the four-way valve 34, the hot gas bypass circuit 38, the low-pressure side piping 33*b*, the four-way valve 34, and the branch pipe 11*b* as indicated by arrow marks in the figure.

Figure 2:
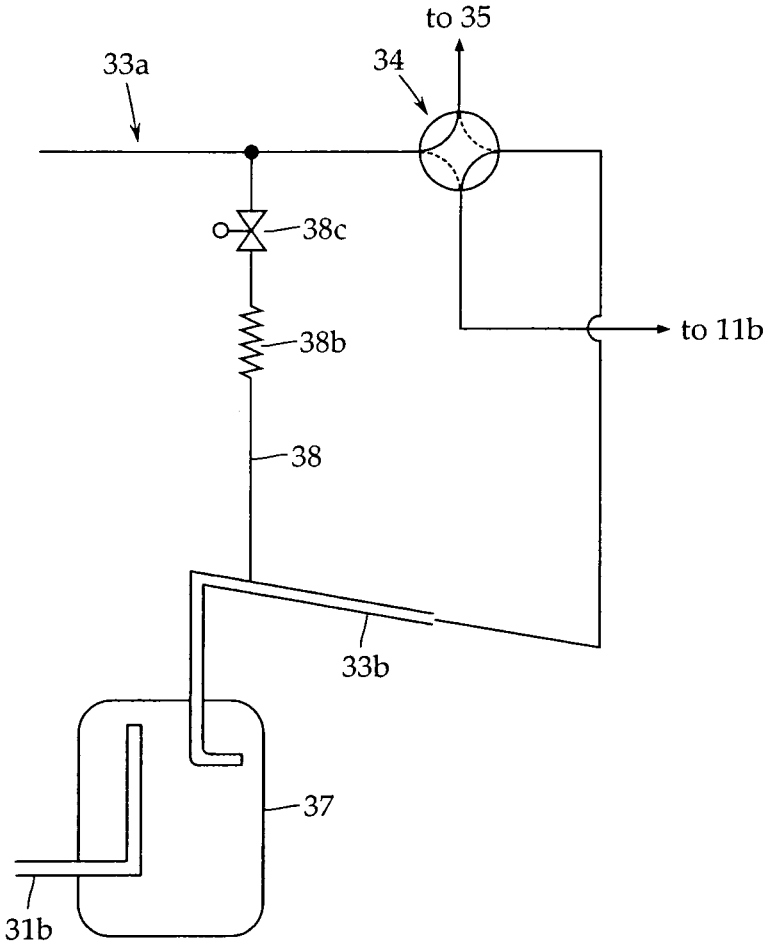
FIG. 2 is a schematic view showing a construction of a connecting part of a hot gas bypass circuit to low-pressure piping.

In this case, as shown in FIG. 2, it is preferable that the connecting part to which the hot gas bypass circuit 38 is connected be tilted so that the refrigerant supplied via the hot gas bypass circuit 38 does not flow to the accumulator 37 side on account of gravity.

As described above, according to the present invention, the refrigerant accumulating in the non-operating outdoor unit 30B can be supplied quickly to the outdoor unit 30A being operated, in which the refrigerant runs short, without starting the compressor 31 of the non-operating outdoor unit 30B.

In the above-described embodiment, two outdoor units are provided. However, the present invention can be applied to the case where three or more outdoor units are provided. Also, in the case where desired subcooling can be performed by the outdoor heat exchanger only, the subcooling heat exchanger may be omitted.

The invention claimed is:

1. A refrigeration apparatus in which to refrigerant piping including liquid-side piping and gas-side piping installed between the indoor side and the outdoor side, a plurality of indoor units each including an indoor expansion valve and an indoor heat exchanger are connected in parallel on the indoor side and a plurality of outdoor units each including a compressor, a directional control valve, an outdoor heat exchanger, an outdoor expansion valve, and an accumulator are connected in parallel on the outdoor side; and each of the outdoor units is provided with a hot gas bypass circuit which includes a solenoid valve and an expansion mechanism arranged in series, and is connected between high-pressure piping on the discharge side of the compressor and low-pressure piping on the accumulator side, wherein if a shortage of refrigerant occurs in the refrigerant piping when air cooling operation is performed in a state in which at least only one outdoor unit of the plurality of outdoor units is operated and other outdoor units are not operated, the solenoid valves of the outdoor units not being operated are opened so that the refrigerant accumulating in the outdoor heat exchangers of the outdoor units not being operated is supplied to the gas-side piping of the refrigerant piping via the hot gas bypass circuit and the low-pressure piping, and the connecting part of the low-pressure piping to which the hot gas bypass circuit is connected is tilted so that the refrigerant supplied via the hot gas bypass circuit does not flow to the accumulator side on account of gravity.

* * * * *